US008240989B2

(12) United States Patent
Liu et al.

(10) Patent No.: US 8,240,989 B2
(45) Date of Patent: Aug. 14, 2012

(54) FAN

(75) Inventors: Wen-Bin Liu, Taoyuan Hsien (TW); Shuo-Shiu Hsu, Taoyuan Hsien (TW); Shun-Chen Chang, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 1084 days.

(21) Appl. No.: 12/147,062

(22) Filed: Jun. 26, 2008

(65) Prior Publication Data

US 2009/0226312 A1 Sep. 10, 2009

(30) Foreign Application Priority Data

Mar. 7, 2008 (TW) ..... 97108186 A

(51) Int. Cl.
*F03D 1/04* (2006.01)

(52) U.S. Cl. ..... 415/216.1; 45/219.1; 45/218.1

(58) Field of Classification Search ..... 415/209.3, 415/216.1, 218.1, 219.1
See application file for complete search history.

(56) References Cited

U.S. PATENT DOCUMENTS 3,574,480 A * 4/1971 Hoepfner ..... 415/211.1
3,644,056 A * 2/1972 Wiselius ..... 415/218.1
3,727,593 A * 4/1973 Enke ..... 123/41.12
4,802,771 A * 2/1989 Weetman ..... 366/270
4,850,802 A * 7/1989 Pankratz et al. ..... 416/213 R
4,909,711 A * 3/1990 Burgbacher et al. ..... 417/354
5,695,318 A * 12/1997 Harmsen ..... 415/218.1
7,052,236 B2 * 5/2006 Chang et al. ..... 415/191
8,029,251 B2 * 10/2011 Oguma ..... 417/354
2006/0045736 A1 * 3/2006 Lee et al. ..... 415/220
2006/0223389 A1 * 10/2006 Bushman ..... 440/47
2007/0284955 A1 * 12/2007 Chang et al. ..... 310/59
2008/0152502 A1 * 6/2008 Luo ..... 416/223 R
2009/0226312 A1 * 9/2009 Liu et al. ..... 415/211.2

FOREIGN PATENT DOCUMENTS

TW I273175 2/2007
TW I281846 5/2007

* cited by examiner

*Primary Examiner* — George Fourson, III
(74) *Attorney, Agent, or Firm* — Muncy, Geissler, Olds & Lowe, PLLC

(57) ABSTRACT

A fan includes a fan frame and an impeller. The fan frame includes a frame body and a base, and the impeller is accommodated in the main body and is disposed on the base. The frame body has a column-shaped passage, an airflow outlet and an airflow inlet. The main body further has two expansion portions respectively disposed adjacent to the outlet and inlet. The expansion portions extend from the column-shaped passage to the outlet and the inlet, respectively. The main body has at least two planar sides so as to allow parts of the expansion portions to respectively form straight-cut lines where the planar sides are located, respectively. The base has several straight-cut planes, and each of the straight-cut planes is located with respect to the straight-cut line.

7 Claims, 7 Drawing Sheets

FAN

CROSS REFERENCE TO RELATED APPLICATIONS

This Non-provisional application claims priority under 35 U.S.C. §119(a) on Patent Application No(s). 097108186, filed in Taiwan, Republic of China on Mar. 7, 2008, the entire contents of which are hereby incorporated by reference.

BACKGROUND OF THE INVENTION

1. Field of Invention

The present invention relates to a fan and a fan frame.

2. Related Art

Since the performances of electronic products have been improved, a heat dissipation device becomes one of the indispensable equipments for the electronic products. If the heat generated by the electronic product can not be dissipated properly, the performance may deteriorate and, even worse, the electronic product may be burnt out. Especially for the micro electronic devices such as the integrated circuits (ICs), the dissipation device is much more important. Because the integrated density of the ICs increases and the packaging technology progresses, the size of the ICs becomes smaller. Thus, the heat accumulated in per unit area becomes higher. Therefore, the heat dissipation device with high heat dissipation efficiency has become one of the most important development areas in the electronic industry.

A fan is the most popular heat dissipation device, as shown in FIGS. 1A and 1B, a fan frame 10 of a conventional axial-flow fan is a square structure. A base 12 is disposed in the main body 11 of the fan frame 10 and is adjacent to the outlet S. The base 12 is connected to the main body 11 through a plurality of ribs 13. In order to increase the outlet area for airflows, the main body 11 has several arc guiding angles R disposed around the outlet S. However, the square structure of the fan frame 10 has the geometrical limitation. That is, parts of the guiding angles R disposed at the side edges of the square structure will form several straight-cut lines P. In this case, the distance between the base 12 and the straight-cut line P is different from that between the base 12 and the guiding angle R. Thus, the variation of the area of the outlet S is too large, which may result in the large difference between the airflow speeds at the outlet S. This will cause the turbulence of the airflow at the outlet S and thus increase the noise.

SUMMARY OF THE INVENTION

In view of the foregoing, the present invention is to provide a fan and a fan frame thereof that have the integrated design of the main body and the base so as to improve the performance of the fan and increase air volume and air pressure. In addition, the present invention can prevent the turbulence occurred at the outlet of the fan so as to decrease the noise.

To achieve the above, the present invention discloses a fan frame including a main body and a base. The main body has a column-shaped passage, an outlet and an inlet. The main body further has two expansion portions disposed adjacent to the outlet and the inlet, respectively. The expansion portions stretch outwardly and extend from the column-shaped passage to the outlet and the inlet, respectively. The main body has at least two planar sides so as to allow parts of the expansion portion to respectively form a straight-cut line where each planar side is located. The base has at least two straight-cut planes, each of which is located with respect to the straight-cut line of the expansion portion.

To achieve the above, the present invention further discloses a fan including a fan frame and an impeller. The fan frame includes a main body and a base, and the impeller is accommodated in the main body and disposed on the base. The main body has a column-shaped passage, an outlet and an inlet. The main body further has expansion portions disposed adjacent to the outlet and inlet, respectively. The expansion portions stretch outwardly and extend from the column-shaped passage to the outlet and inlet, respectively. The main body has at least two planar sides so as to allow parts of the expansion portion to respectively form a straight-cut line where each planar side is located. The base has at least two straight-cut planes, each of which is located with respect to the straight-cut line of the expansion portion.

In addition, the present invention also discloses a fan including a fan frame and an impeller. The fan frame includes a main body and a base. The main body has a column-shaped passage, an outlet and an inlet, and the base is disposed in the main body and is adjacent to the outlet. The impeller is accommodated in the main body and disposed on the base. The impeller has a hub and a plurality of blades disposed around the hub. The diameter of the hub increases gradually from the inlet to the outlet so as to form at least one slant plane. The base has an inclined plane corresponding to the slant plane of the hub. The slant plane of the hub and the inclined plane of the base are roughly located at the same plane.

As mentioned above, the fan and fan frame of the present invention have the integrated design of the base and the main body, so that the distance between the outer surface of the base and the inner surface of the main body can be uniform. Thus, the airflow field through the outlet can be kept steady so as to reduce the interference of the turbulence. Also, the design of the present invention allows the airflow to flow through the slant plane of the hub and then sequentially through the inclined plane of the base, thereby achieving the effect of continuously pressing. Compared with the conventional fans, the present invention not only improves the fan characteristics and increases the air volume and air pressure for the fan, but also prevents the turbulence generated at the outlet so as to decrease the noise.

BRIEF DESCRIPTION OF THE DRAWINGS

The present invention will become more fully understood from the subsequent detailed description and accompanying drawings, which are given by way of illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1A:
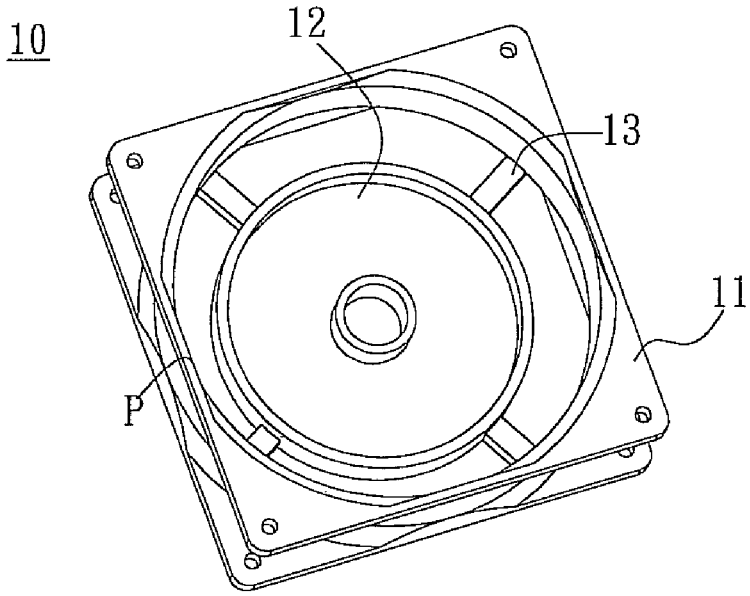
FIG. 1A(PRIOR ART)
FIG. 1A is a schematic illustration showing a conventional fan frame.
Figure 1B:
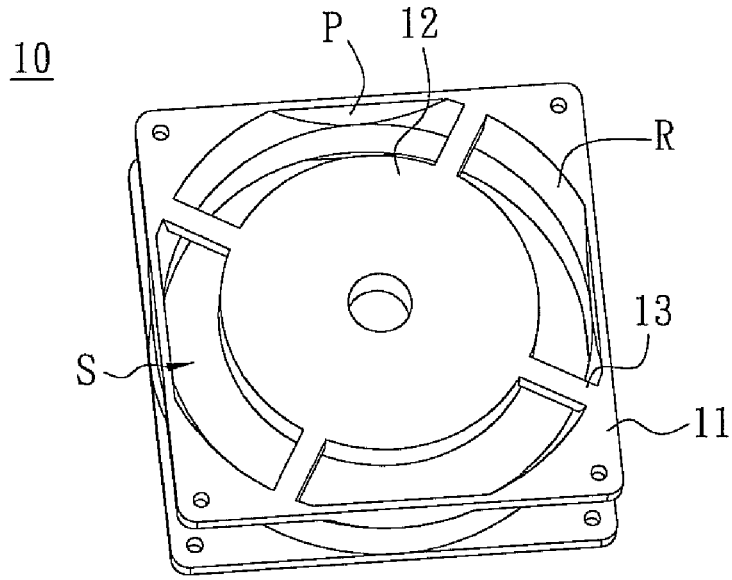
FIG. 1B(PRIOR ART)
FIG. 1B is another schematic view showing the fan frame in FIG. 1A.
Figure 2A:
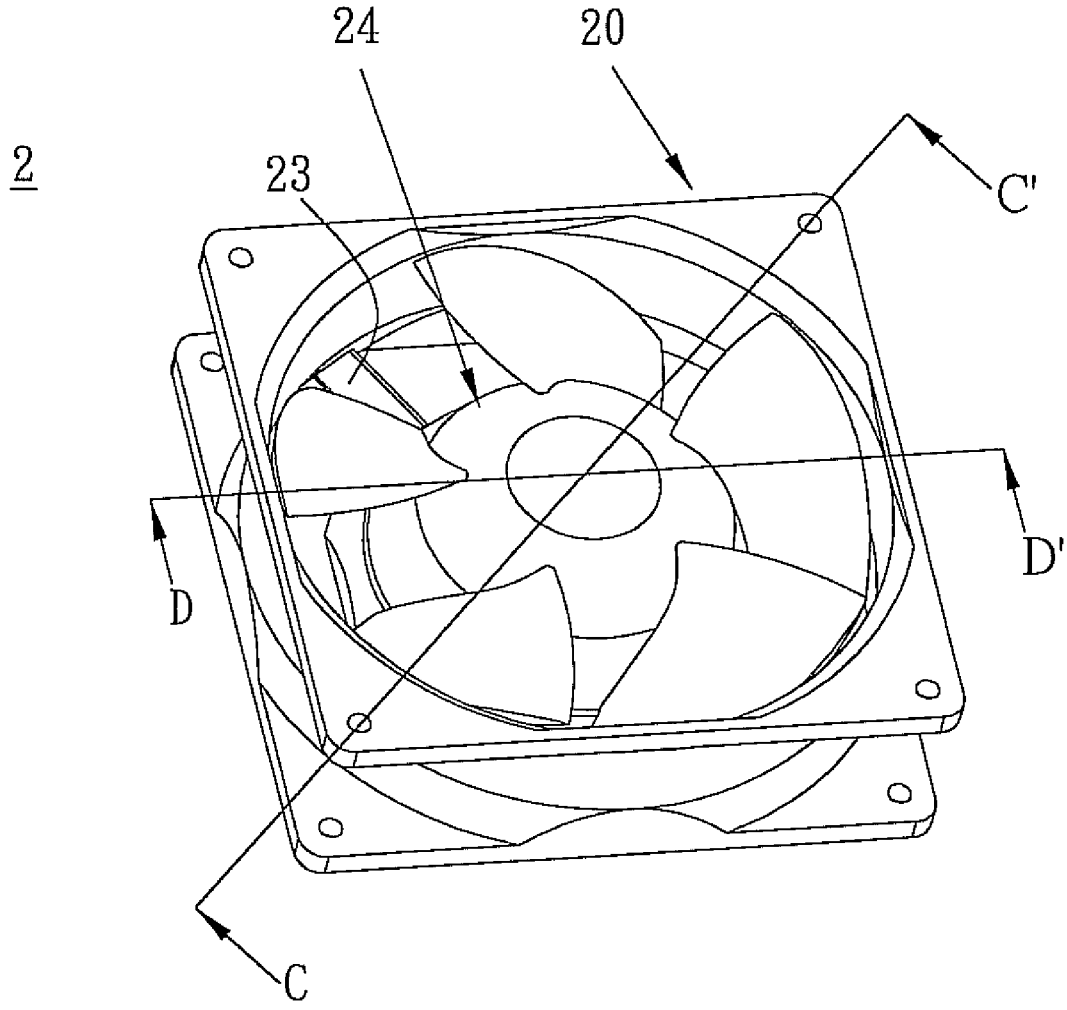
FIG. 2A is a schematic illustration showing a fan according to the preferred embodiment of the present invention.
Figure 2B:
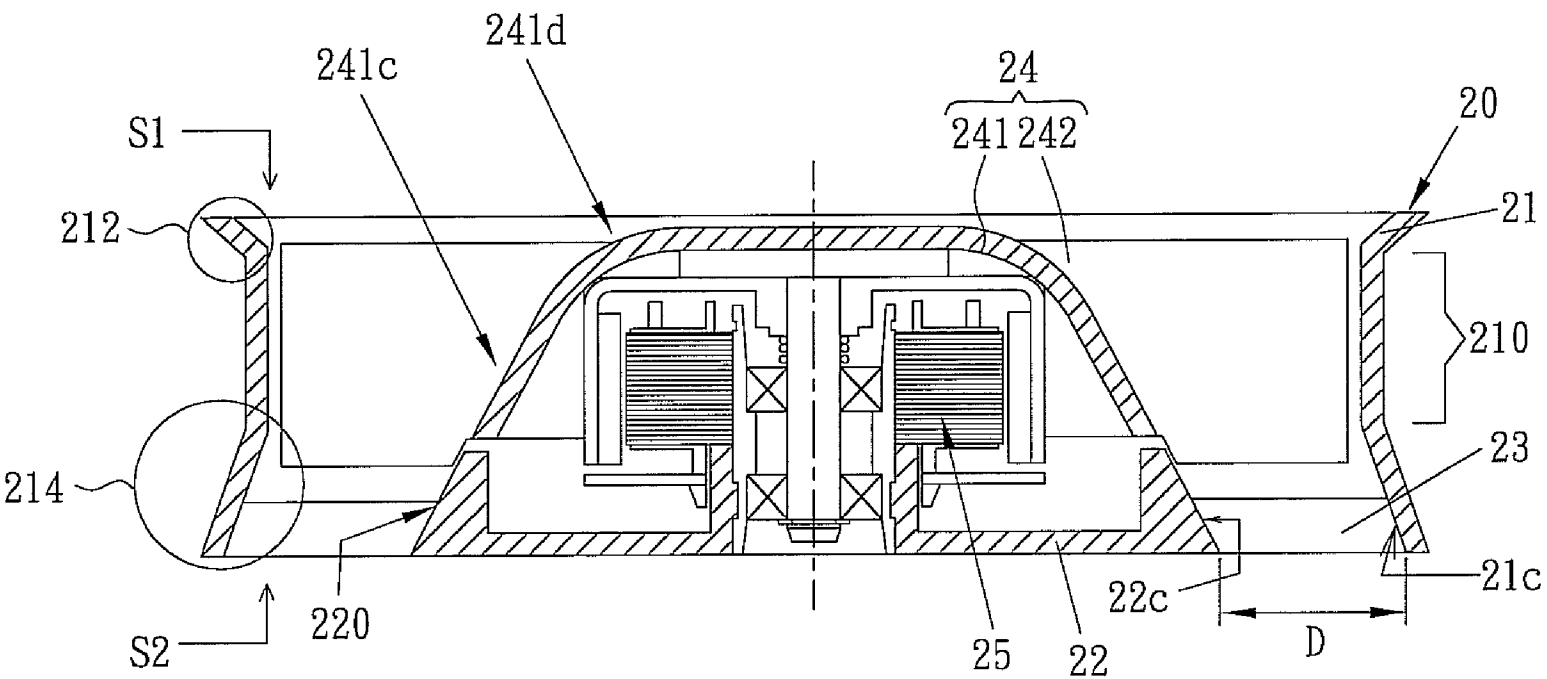
FIG. 2B is a cross sectional view of the fan in FIG. 2A along line CC'.

FIG. 2A is a schematic illustration showing a fan according to the preferred embodiment of the present invention, and FIG. 2B is a cross sectional view of the fan in FIG. 2A along line CC'. With reference to FIGS. 2A and 2B, a fan 2 includes a fan frame 20, an impeller 24 and a motor 25. In the embodiment, the fan 2 is, for example but not limited to, an axial-flow fan. The fan frame 20 includes a main body 21 and a base 22. The main body 21 can have a square, rectangular or elliptic shape, which is designed according to the actual needs. In the embodiment, the shape of the main body 21 is square.

The base 22 is disposed in the main body 21. The fan frame 20 further includes a plurality of connecting members 23 disposed between the main body 21 and the base 22 for connecting the main body 21 and the base 22. In the embodiment, the connecting members are ribs, which are integrally formed with the base 22 and the main body 21 as a single piece. However, the above-mentioned example is not to limit the scope of the present invention, and the connecting members 23 may also be stationary blades with the airflow guiding function.

The main body 21 has an inlet S1, an outlet S2 and a column-shaped passage 210. In order to increase the air inlet and outlet areas, the main body 21 has an expansion portion 212 and an expansion portion 214 disposed adjacent to the inlet S1 and the outlet S2, respectively. The expansion portions 212 and 214 stretch outwardly and extend from the column-shaped passage 210 to the inlet S1 and the outlet S2, respectively. Preferably, the column-shaped passage 210 and the expansion portions 212 and 214 are integrally formed as a single piece. In the embodiment, each of the expansion portions 212 and 214 is formed as, for example, an arc guiding angle.

When the base 22 is preferably disposed adjacent to the outlet S2, the base 22 has an inclined plane 220 corresponding to the expansion portion 214. Thus, no matter from the top or bottom of the base 22, the distances between the main body 21 and the base 22 are kept uniform. Accordingly, when the airflows pass through the space between the base 22 and the expansion portion 214, the steady pressure effect is obtained.

Figure 2C:
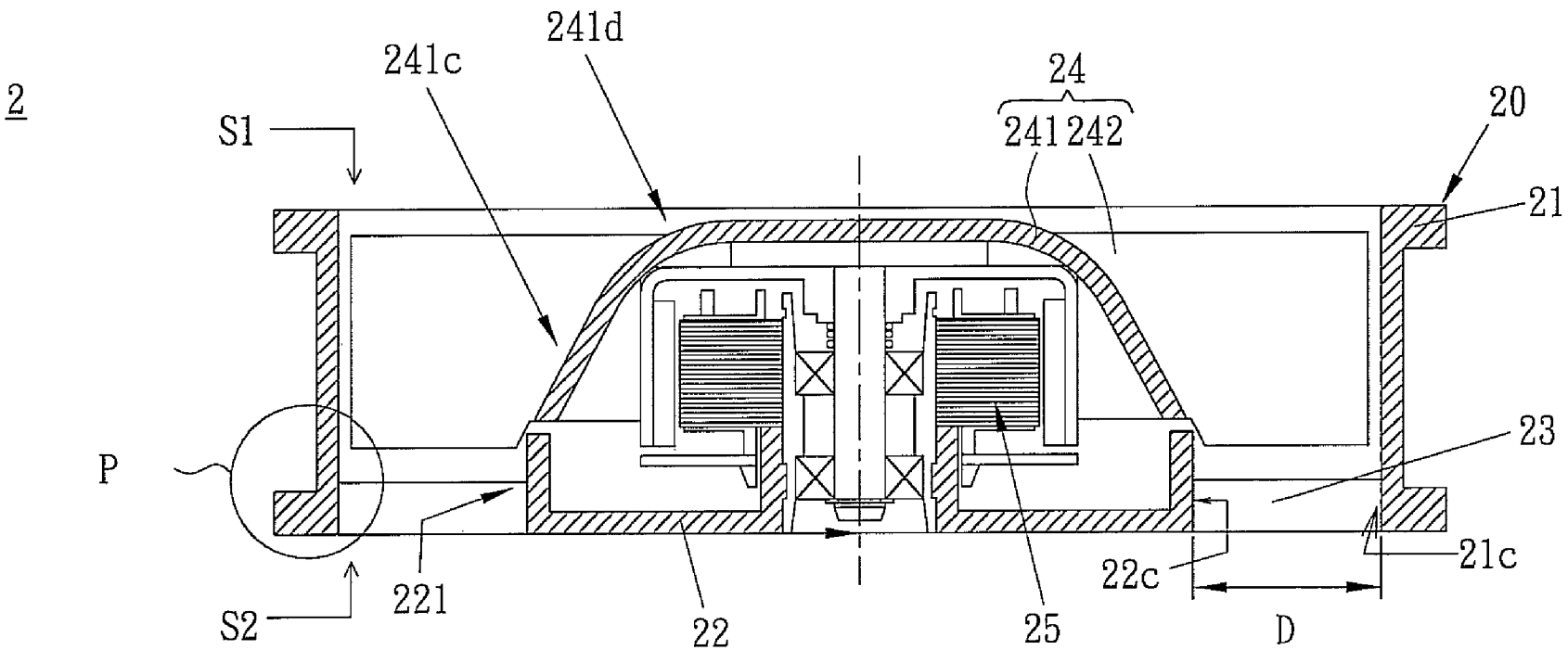
FIG. 2C is a cross sectional view of the fan in FIG. 2A along line DD'.
Figure 2D:
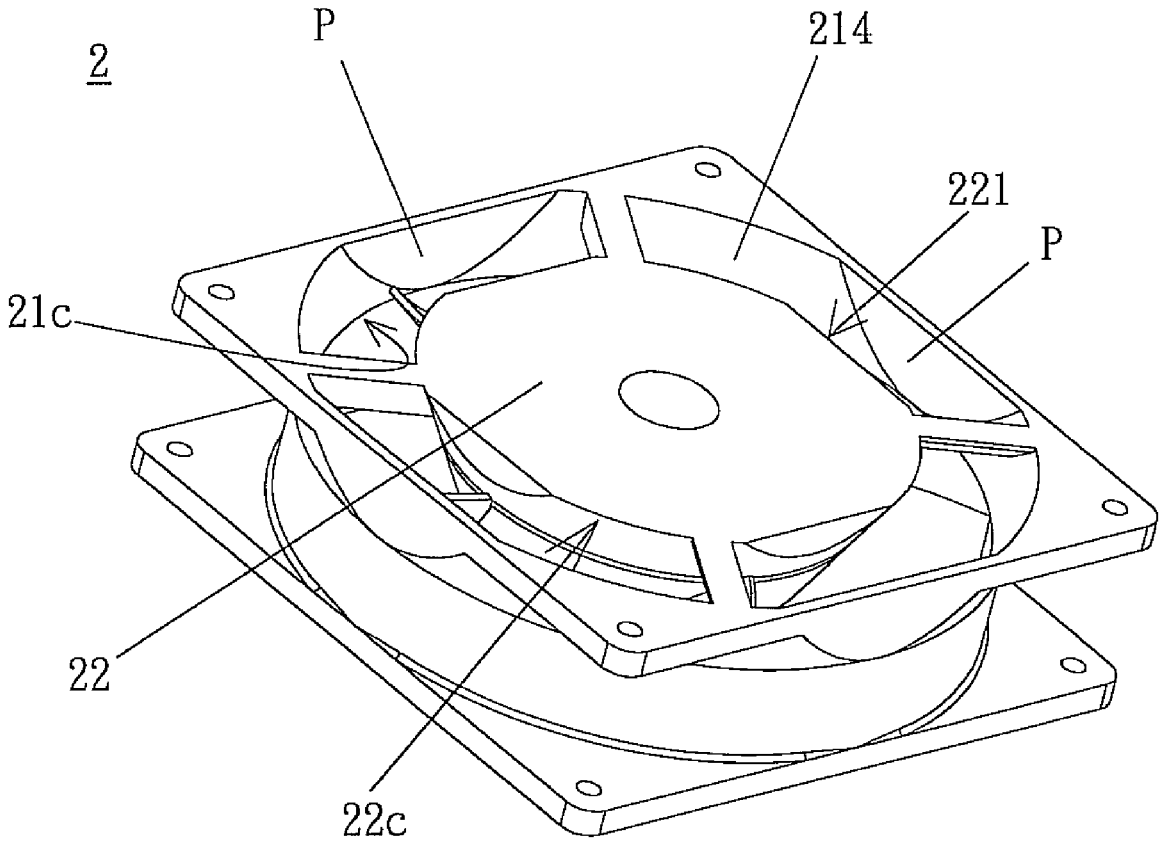
FIG. 2D is another schematic view showing the fan in FIG. 2A.

FIG. 2C is a cross sectional view of the fan in FIG. 2A along line DD', and FIG. 2D is another schematic view showing the fan in FIG. 2A. In the present invention, the main body 21 has at least two opposite planar sides. With reference to FIGS. 2C and 2D, the main body 21 of the embodiment is square, so it has four planar sides. Since the center of each planar side is tangential to the column-shaped passage 210, parts of the expansion portion 214 where the four planar sides are located will respectively form straight-cut lines P, which are the same as the conventional fan. To prevent exceeding differences of the airflow speeds at the outlet in the conventional fans, the present invention designs the base 22 to have four straight-cut planes 221, each of which is located with respect to each straight-cut line P of the expansion portion 214. In the embodiment, the expansion portion 214 and the base 22 have a roughly uniform distance D therebetween, i.e. the distance D between the base 22 and the expansion portion 214 can be roughly the same around the base 22 even at the straight-cut lines P. In other words, no matter at the straight-cut lines P or not, the airflow outlet does not have obvious variation in area. Thus, the difference between the airflow speeds at the outlet S2 can be eliminated, so that the turbulence can be prevented and the noise can be decreased. To be noted, the present embodiment discloses that the distance D between the base 22 and the expansion portion 214 is roughly the same around the base 22 even at the straight-cut lines P, but it is not to limit the scope of the present invention. In the scope of the present invention, the distance D may be slightly varied, as long as the base having the structure of straight-cut planes for decreasing the variation of the airflow outlet area.

An impeller 24 and a motor 25 are both accommodated in the main body 21 and are disposed on the base 22. The motor 25 drives the impeller 24 to rotate so as to generate airflows. In addition, the impeller 24 has a hub 241 and a plurality of blades 242 disposed around the hub 241.

In order to make the airflow entering the fan 2 more stable, the diameter of the hub 241 of the impeller 24 increases gradually along a direction of from the inlet S1 to the outlet S2. The hub 241 has at least one slant plane 241*c* and at least one curved plane 241*d*. The curved plane 241*d* is disposed close to the inlet S1 for increasing the area for the airflow entering the fan 2. When the airflow passes through the slant plane 241*c* of the hub 241, the radial pressing effect can be applied to the airflow. Then, the inclined plane 220 of the base 22 can guide the airflow. Since the slant plane 241*c* of the hub 241 and the inclined plane 220 of the base 22 are roughly located at the same plane, the radial pressing effect can be still applied to the airflow in the region from the top of the base 22 to the outlet S2. Thus, the continuously radial pressing effect can be applied to the airflow in the fan 2.

In addition, as shown in FIGS. 2B and 2C, the end portions of the blades 242 preferably cover the top surface of the base 22. This configuration can enlarge the total area of the blades 242 so as to achieve the effect of increasing air volume.

Figure 3A:
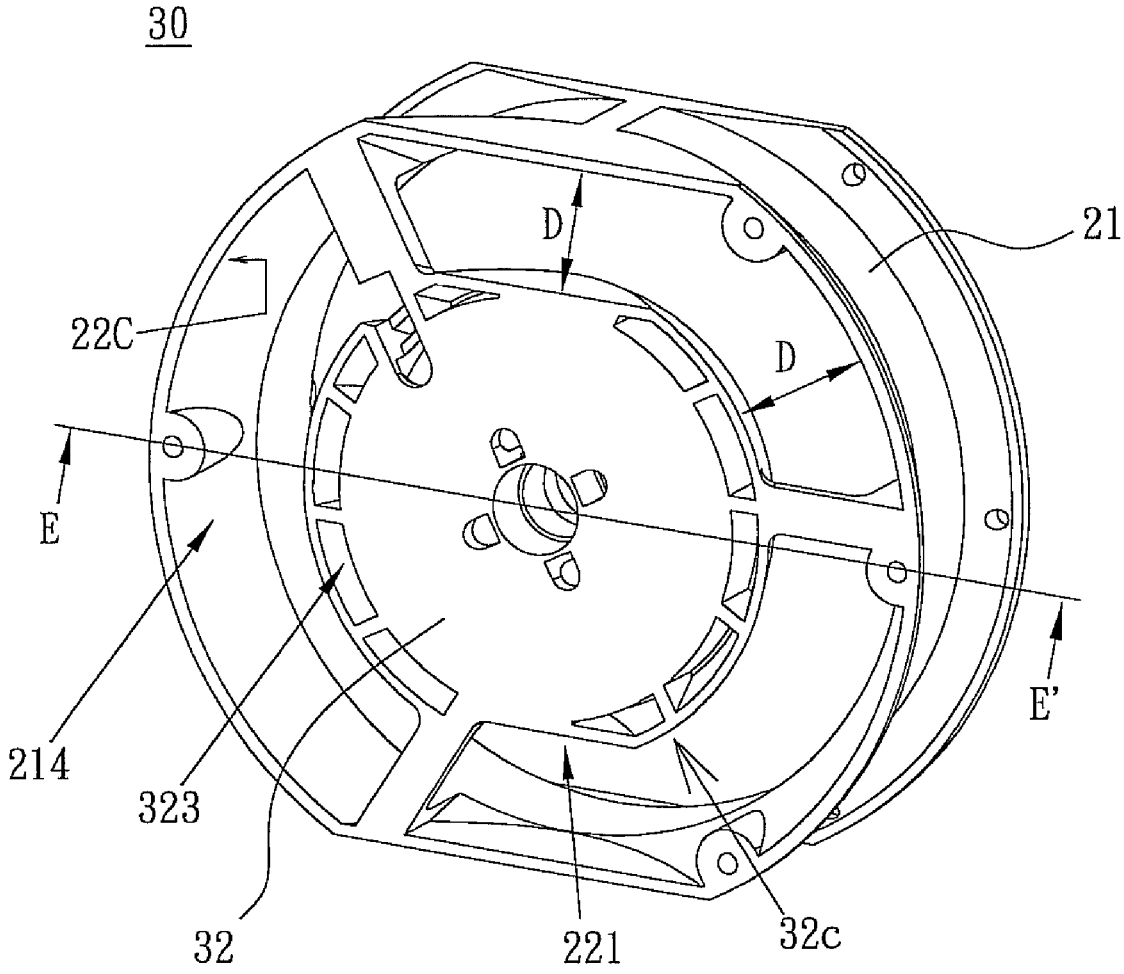
FIG. 3A is a schematic illustration showing another fan frame for the fan in FIG. 2A.
Figure 3B:
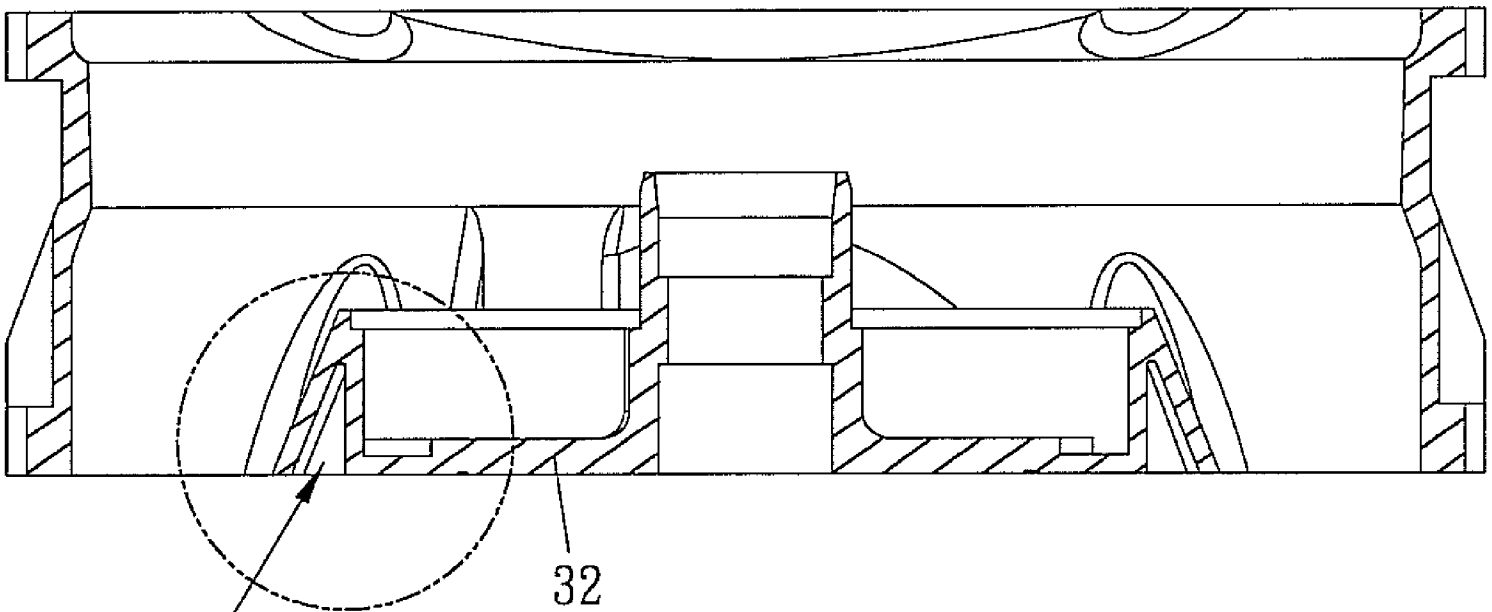
FIG. 3B is a cross sectional view of the fan frame in FIG. 3A along line EE'.

FIG. 3A is a schematic illustration showing another fan frame for the fan in FIG. 2A, and FIG. 3B is a cross sectional view of the fan frame in FIG. 3A along line EE'. With reference to FIGS. 3A and 3B, the fan frame 30 is similar to the previously mentioned fan frame 20, and the base 32 of the fan frame 30 has uniform thickness so as to reduce the material cost. In practice, at least one recess 323 can be formed on the bottom surface of the base 32 and the recess 323 is adjacent to a side wall of the base 32, so that the base 32 can still have the inclined plane as that of the base 22 and the purpose of reducing the material cost can still be achieved.

In summary, the fan and fan frame of the present invention have the integrated design of the base and the main body, so that the distance between the outer surface 22*c*/32*c* of the base 22/32 and the inner surface 21*c* of the main body 21 can be uniform. Thus, the airflow field through the outlet can be kept steady so as to reduce the interference of the turbulence. Also, the design of the present invention allows the airflow to flow through the slant plane of the hub and then sequentially through the inclined plane of the base, thereby achieving the effect of continuously pressing. Compared with the conventional fans, the present invention not only improves the fan characteristics and increases the air volume and air pressure for the fan, but also prevents the turbulence generated at the outlet so as to decrease the noise.

Although the present invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the present invention.

What is claimed is:

1. A fan, comprising:

a fan frame comprising a main body and a base, wherein the main body has a column-shaped passage, an outlet and an inlet, and the base is disposed in the main body and is adjacent to the outlet; and an impeller accommodated in the main body and disposed on the base, wherein the impeller has a hub and a plurality of blades disposed around the hub;

wherein the diameter of the hub increases gradually from the inlet to the outlet so as to form at least one slant plane, the base has an inclined plane corresponding to the slant plane of the hub, and the slant plane of the hub and the inclined plane of the base are roughly located at the same plane, wherein the main body has a first expansion portion disposed adjacent to the outlet, the first expansion portion stretches outwardly and extends from the column-shaped passage to the outlet, the main body further has at least two planar sides so as to allow parts of the first expansion portion to respectively form a straight-cut line where each planar side is located, the base has at least two straight-cut planes, and each of the straight-cut planes is located coaxially to the straight-cut line of the first expansion portion, and the straight-cut line and the straight-cut planes are substantially perpendicular to a surface of the outlet.

2. The fan according to claim 1, wherein the inclined plane of the base is disposed corresponding to the first expansion portion, so that from a top or a bottom of the base, distances between the inclined plane of the base and the first expansion portion of the main body are kept uniform.

3. The fan according to claim 1, wherein the base has at least one recess, the recess is disposed on a bottom surface of the base and the recess is adjacent to a side wall of the base.

4. The fan according to claim 1, wherein the first expansion portion and the base have a roughly uniform distance therebetween, and the first expansion portion is formed as an arc guiding angle.

5. The fan according to claim 1, wherein the main body further has a second expansion portion disposed adjacent to the inlet, and the second expansion portion stretches outwardly and extends from the column-shaped passage to the inlet.

6. The fan according to claim 1, wherein the hub further has at least one curved plane disposed at the inlet, and end portions of the blades cover a top surface of the base.

7. The fan according to claim 1, further comprising a motor drives the impeller to rotate, and the motor is accommodated in the main body and is disposed on the base.

* * * * *